US009618268B2

(12) United States Patent
Shi et al.

(10) Patent No.: US 9,618,268 B2
(45) Date of Patent: Apr. 11, 2017

(54) EVAPORATIVE CONDENSER RADIATING MODULE FOR STEAM EXHAUST OF A STEAM TURBINE

(75) Inventors: Honghui Shi, Shanxi (CN); Qingzhong Ma, Shanxi (CN); Jin Wang, Shanxi (CN); Jiayong Lu, Shanxi (CN); Longying Zhang, Shanxi (CN); Zhigang Bai, Shanxi (CN)

(73) Assignees: Shanxi Electric Power Research Institute, Shanxi (CN); Shanxi Electric Power Company, Shanxi (CN)

( * ) Notice: Subject to any disclaimer, the term of this patent is extended or adjusted under 35 U.S.C. 154(b) by 599 days.

(21) Appl. No.: 13/882,154

(22) PCT Filed: Aug. 29, 2011

(86) PCT No.: PCT/CN2011/001446

§ 371 (c)(1),
(2), (4) Date: Apr. 26, 2013

(87) PCT Pub. No.: WO2012/145875

PCT Pub. Date: Nov. 1, 2012

(65) Prior Publication Data

US 2014/0034273 A1 Feb. 6, 2014

(30) Foreign Application Priority Data

Apr. 29, 2011 (CN) ..... 2011 1 0111009

(51) Int. Cl.
*F28F 9/26* (2006.01)
*F28B 1/06* (2006.01)
(Continued)

(52) U.S. Cl.
CPC ..... *F28B 1/06* (2013.01); *F01K 9/00* (2013.01); *F28B 7/00* (2013.01); *F28D 7/163* (2013.01); *F28F 9/26* (2013.01)

(58) Field of Classification Search
CPC ..... F28B 1/06; F28B 1/065; F28F 9/26; F28F 9/262
(Continued)

(56) References Cited

U.S. PATENT DOCUMENTS 1,435,612 A * 11/1922 Ljungstrom ..... F28B 1/06 165/146
3,422,883 A * 1/1969 Daltry ..... E04H 5/12 165/47
(Continued)

FOREIGN PATENT DOCUMENTS

CN 1048262 A 1/1991
CN 201293561 Y 8/2009
(Continued)

OTHER PUBLICATIONS

International Search Report for International Application No. PCT/CN2011/001446 mailed on Feb. 9, 2012 in 8 pages.

*Primary Examiner* — Leonard R Leo
(74) *Attorney, Agent, or Firm* — Knobbe, Martens, Olson & Bear, LLP

(57) ABSTRACT

An evaporative condenser radiating module for steam exhaust of a steam turbine comprises tube bundles and steam-water separating chambers. A steam-water separating chamber (4) between a section A and a section B, a section A downflow cooling section tube bundle (3), a section B downflow cooling section tube bundle (5), and a counter flow cooling section tube bundle (8) are disposes at the left side of a central steam-water separating chamber (7). An upper sealed space (10) of the steam-water separating chamber (4) between the section A and the section B is in communication with the central steam-water separating chamber (7) through the counter flow cooling section tube bundle (8). A lower sealed space of the steam-water separating chamber (4) between the section A and the section B
(Continued)

is in communication with the central steam-water separating chamber (7) through the section B downflow cooling section tube bundle (5). A sealed section A steam entering chamber (2) is arranged on the left side of the steam-water separating chamber (4) between the section A and the section B. The section A downflow cooling section tube bundle (3) is arranged between the section A steam entering chamber (2) and the lower sealed space of the steam-water separating chamber (4) between the section A and the section B. The right side of the central steam-water separating chamber (7) is provided with tube bundles and steam-water separating chambers totally structurally identical with those arranged on the left side of the central steam-water separating chamber (7).

3 Claims, 3 Drawing Sheets

(51) Int. Cl.
*F28B 7/00* (2006.01)
*F28D 7/16* (2006.01)
*F01K 9/00* (2006.01)

(58) Field of Classification Search
USPC ..... 165/111, 114, 144, 146, 900
See application file for complete search history.

(56) References Cited

U.S. PATENT DOCUMENTS 3,543,843 A * 12/1970 Gunter ..... F28B 1/06 165/111
3,556,204 A * 1/1971 Manfred ..... F28B 1/06 165/111
3,844,344 A * 10/1974 Kliemann ..... F28B 1/06 165/900
3,942,588 A * 3/1976 Schoonman ..... F28B 1/06 165/900
4,165,783 A * 8/1979 Oplatka ..... F22G 1/005 165/111
4,168,742 A * 9/1979 Kluppel ..... F28B 1/06 165/114

FOREIGN PATENT DOCUMENTS

CN 101526313 A 9/2009
CN 201772768 U 3/2011
CN 102141347 * 8/2011
CN 102141347 A 8/2011
EP 0854341 A2 7/1998
GB 2051596 A 1/1981

* cited by examiner

I–I

H–H

EVAPORATIVE CONDENSER RADIATING MODULE FOR STEAM EXHAUST OF A STEAM TURBINE

BACKGROUND

Field

The invention relates to a condenser, and more specifically, to a radiating module in a condenser which is in parallel connection with an air cooled island and is used for evaporative condensing the steam exhausted from the stream turbine.

Description of the Related Art

A direct air cooled unit employs air as the cooling medium to cool the exhausted stream from the turbine. Since air has a low density, a low specific heat capacity, and a low heat transfer coefficient, the provided temperature rise at the air side of the air cooled system is much higher than in the water cooled system, and the design back pressure at the air side of the air cooled system is also higher than in the water cooled system. This will greatly affect thermal efficiency of the unit. There are some problems, as follows, commonly existing in the actual operation of the air cooled unit. Firstly, the operational back pressure will rise when the air cooled system is contaminated, which adversely affects the economical efficiency. Secondly, the large variation range of the back pressure during the operation of the air cooled unit degrades the security and reliability of the unit operation. Thirdly, the operational back pressure of the unit depends highly on environmental factors, and therefore, the unit will experience a high load due to a high back pressure during high environmental temperature. To solve these problems, an auxiliary water cooled system is commonly used to improve the heat exchange capacity of the air cooled system so as to ensure the safety and economical efficiency of the unit, such as a mist cooled system, a parallel water-tower condenser water cooled system, a tandem evaporative condenser system. The evaporative condenser is a novel cooling device, which has been widely used in the field of refrigeration and chemical engineering industry, and has been used as a condenser for exhausted steam from the low pressure cylinder of the steam turbine in a small-scale unit, but is still under development for large-scale unit. The evaporative condenser as applied in the power station condensing system is quite different from that used in the refrigeration system in technical respect. The following aspects in the system and structural design should be taken into consideration. In the case that a peak-load evaporative condenser in parallel connection with a direct air cooled system is used to cool a portion of the exhausted steams, it is not applicable to employ tens of unitary evaporative condensers for a large-scale unit due to a large foot print resulting from the large scale of equipments, and due to high requirements on large cooling heat capacity and on ventilation height. The tube bundles for the refrigeration system are usually designed as coiled tubes, which is not applicable for cooling the exhausted stream from a turbine which has a large specific heat capacity due to its large frictional drag on the way. The frictional drag should be reduced in the case of application of an evaporative condenser in a power station condensing system, so as to reduce the operational back pressure of the unit and raise the operational efficiency. In the case of a peak-load evaporative condenser in parallel connection with a direct air cooled system, the vacuum system of the turbine will inevitably experience air leakage because of the negative pressure inside the tubes of the system.

SUMMARY

The evaporative condenser radiating module for steam exhaust of a steam turbine proposed by the invention solves the problems associated with the prior art, such as a large scale, a large footprint, and inapplicability of employing coiled tubes for cooling the exhausted stream from a turbine with a large specific heat capacity due to a higher friction drag.

The invention solves the above-mentioned problem by means of the following technical solutions.

An evaporative condenser radiating module for steam exhaust of a steam turbine comprises tube bundles and steam-water separating chambers, wherein the steam-water separating chambers are provided with supporting brackets made of steel, and an steam-water separating chamber between a section A and a section B is disposed on the left side of a sealed central steam-water separating chamber, and the steam-water separating chamber between a section A and a section B is provided with a separating plate therein, and the separating plate separates the steam-water separating chamber between a section A and a section B into an upper sealed space and a lower sealed space, and a counterflow cooling tube bundle is communicated between the upper sealed space of the steam-water separating chamber between a section A and a section B and the central team-water separating chamber, and a section B downflow cooling section tube bundle is communicated between the lower sealed space of the steam-water separating chamber between a section A and a section B and the central team-water separating chamber, and the counterflow cooling tube bundle and the section B downflow cooling section tube bundle are arranged parallel with respect to each other, and each forms a 20-degree angle with respect to the horizontal plane, and the upper sealed space of the steam-water separating chamber between a section A and a section B is provided with an air pumping pipe, and the central steam-water separating chamber is provided with a condensing water drainage pipe on the bottom thereof, and a sealed section A steam entering chamber is arranged on the left side of the steam-water separating chamber between the section A and the section B, and section A downflow cooling section tube bundles are arranged between the section A steam entering chamber and the lower sealed space of the steam-water separating chamber between the section A and the section B, and the section A downflow cooling section tube bundles are arranged in parallel with respect to each other, and each forms a 20-degree angle with respect to the horizontal plane, and the section A steam entering chamber is provided with a left steam inlet nozzle on the left side surface thereof, and the right side of the central steam-water separating chamber is provided with tube bundles and a steam-water separating chamber totally structurally identical with those arranged on the left side of the central steam-water separating chamber, such that the whole evaporative condenser radiating module forms a symmetric V shape.

The counterflow cooling tube bundle, the section B downflow cooling section tube bundle and the section A downflow cooling tube bundle can have a same length of 2-2.5 m.

The section A downflow cooling tube bundle may have a same diameter and a same pipe thickness as that of the counterflow cooling tube bundle; the ratio of the diameter of the section B downflow cooling section tube bundle to that of the section A downflow cooling tube bundle is 80/100, and the ratio of the pipe thickness of the section B downflow cooling section tube bundle to that of the section A downflow cooling tube bundle is 2/3.

The counterflow cooling tube bundle, the section B downflow cooling section tube bundle and the section A downflow cooling tube bundle each staggers between the neighboring layers in the horizontal plane of tubes and every two neighboring tubes from the respective neighboring layers forms a 30-degree angle with respect to the horizontal plane in a plane perpendicular to each tube bundle respectively.

The invention can considerable improve the safety and efficiency of the unit. As compared with those of a serial system, the advantage of a parallel peak-load evaporative condenser lie in the fact that the drag of the system can be reduced due to the direct splitting of a portion of the exhausted steam from the low pressure cylinder. In the case that the intake parameters of the air cooling system and the evaporative condenser are the same, the heat exchange capacity is enhanced. After being exhausted, Condensed water from the evaporative condenser and condensed water from the air cooling system mergers and then flows into the condensing system.

DETAILED DESCRIPTION

Figure 1:
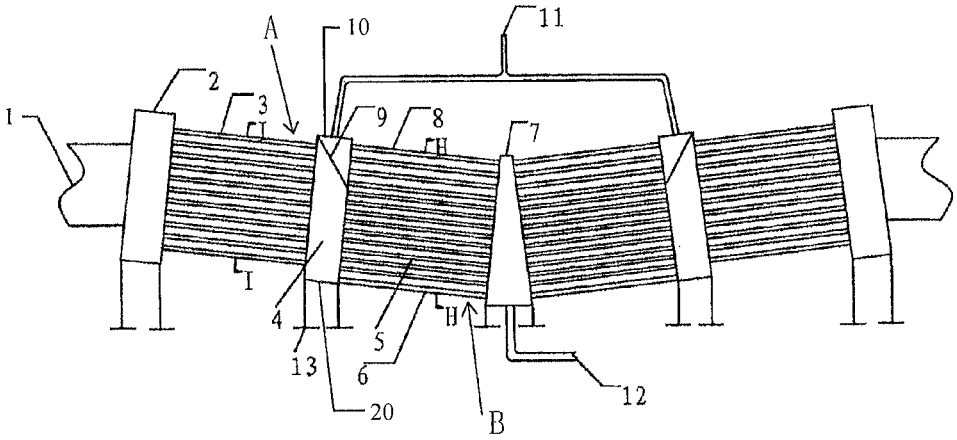
FIG. 1 is a structural view schematically showing the evaporative condenser radiating module according to the invention.
Figure 2:
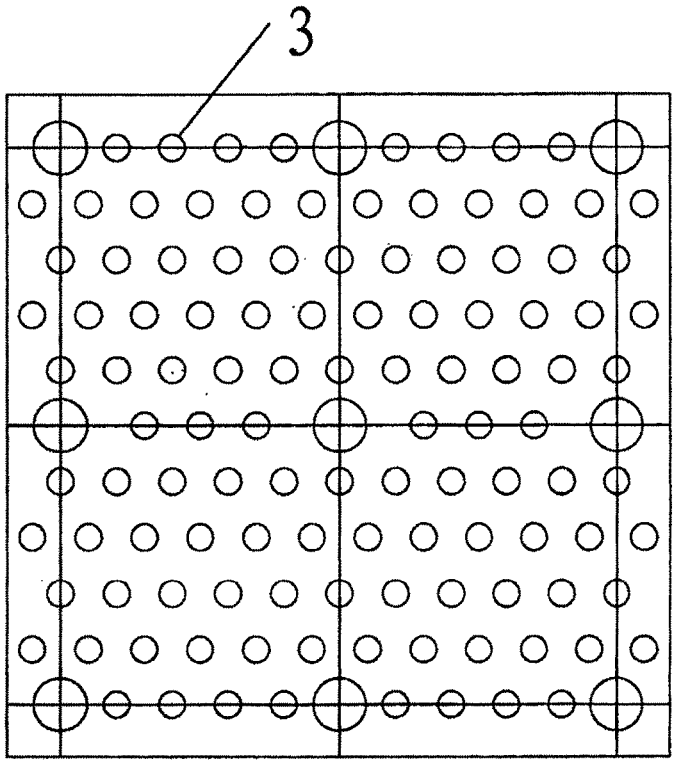
FIG. 2 is a cross sectional view taken along lines I-I in FIG. 1.
Figure 3:
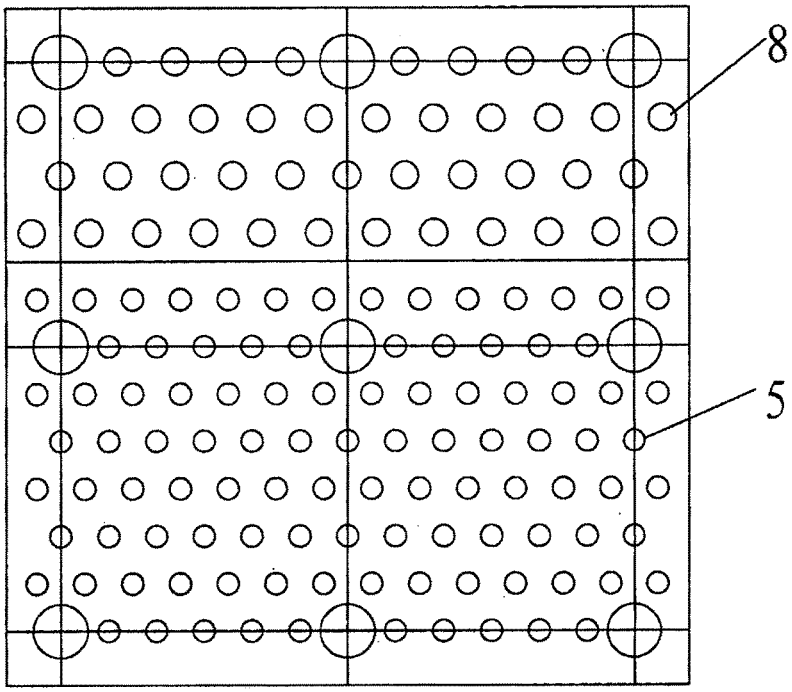
FIG. 3 is a cross section view taken along lines H-H in FIG. 1.

A parallel high-load evaporative condenser comprises a low pressure cylinder 14 of the turbine, and an air cooled island 16. An exhaust pipe 15 for the low pressure cylinder communicating between the low pressure cylinder 14 of the turbine and the air cooled island 16 is communicated with a cooling unit 17. The output of the cooling unit 17 is communicated with the condensing water pump 19 via a condensing water tank 18. The cooling unit 17 comprises tube bundles and a steam-water separating chambers. The steam-water separating chambers are provided with supporting brackets made of steel 13. A steam-water separating chamber 4 between a section A and a section B is disposed on the left side of a sealed central steam-water separating chamber 7. The steam-water separating chamber 4 between a section A and a section B is provided with a separating plate 9 therein, and the separating plate 9 separates the steam-water separating chamber 4 between a section A and a section B into an upper sealed space 10 and a lower sealed space 20. A counterflow cooling tube bundle 8 is communicated between the upper sealed space 10 of the steam-water separating chamber 4 between a section A and a section B and the central team-water separating chamber 7. A section B downflow cooling section tube bundle 5 is communicated between the lower sealed space 20 of the steam-water separating chamber 4 between a section A and a section B and the central team-water separating chamber 7. The counterflow cooling tube bundle 8 and the section B downflow cooling section tube bundle 5 are arranged parallel with respect to each other, and each forms a 20-degree angle with respect to the horizontal plane. The upper sealed space 10 of the steam-water separating chamber 4 between a section A and a section B is provided with an air-pumping pipe 11, and the central steam-water separating chamber 7 is provided with a condensing water drainage pipe 12 on the bottom thereof, and a sealed section A steam entering chamber 2 is arranged on the left side of the steam-water separating chamber 4 between the section A and the section B. The section A downflow cooling section tube bundles 3 are arranged between the section A steam entering chamber 2 and the lower sealed space 20 of the steam-water separating chamber 4 between the section A and the section B. The section A downflow cooling section tube bundles 3 are arranged in parallel with respect to each other, and each of them forms a 20-degree angle with respect to the horizontal plane. The section A steam entering chamber 2 is provided with a left steam inlet nozzle 1 on the left side surface thereof, and the right side of the central steam-water separating chamber 7 is provided with tube bundles and a steam-water separating chamber totally structurally identical with those arranged on the left side of the central steam-water separating chamber 7, such that the whole evaporative condenser radiating module forms a symmetric V shape.

The counterflow cooling tube bundle 8, the section B downflow cooling section tube bundle 5 and the section A downflow cooling tube bundle 3 can have a same length of 2-2.5 m.

The section A downflow cooling tube bundle 3 has a same diameter and a same pipe thickness as that of the counterflow cooling tube bundle 8; the ratio of the diameter of the section B downflow cooling section tube bundle 5 to that of the section A downflow cooling tube bundle 3 is 80/100, and the ratio of the pipe thickness of the section B downflow cooling section tube bundle 5 to that of the section A downflow cooling tube bundle 3 is 2/3.

The counterflow cooling tube bundle 8, the section B downflow cooling section tube bundle 5 and the Section A downflow cooling tube bundle 3 each staggers between the neighboring layers in the horizontal plane of tubes and every two neighboring tubes from the respective neighboring layers forms a 30-degree angle with respect to the horizontal plane in a plane perpendicular to each tube bundle respectively.

The radiating module of the cooling unit intakes stream from both sides thereof, and thereby, the intake flow rate in the pipe is reduced. Therefore, the reduction of system drag is also facilitated, the pipe diameter can be decreased, the heat exchange coefficient can be increased, and the size and the material of the unit can be lowered.

In the case that the radiating module intakes steam from both sides thereof, the flow rate is reduced to 50% of that in the case of intake steam from only one side. Since the flow drag of the steam is approximately proportional to the square of the flow velocity, the inner diameter of the tube bundle can be reduced by 40%, and the material consumption can be decreased by 70% with the same cooling area in the case of intake steam from both sides, taking requirements on system drag and on reductions of flow drag into account. Furthermore, in the case that a smaller pipe diameter is employed, the condensing heat exchange coefficient is increased, the thermal resistance is decreased due to small pipe thickness, and the heat exchange area can be further reduced.

The performance of the radiating module could be further improved by improving the design of the tube bundles based on combination of the structural features of the radiating module with the condensation characteristics of the steam to be cooled in different phrases.

Based on the design of intake steam from both sides, the processes of the intake side bundles are further optimized. The intake side includes three processes as follows. The intake enters the downflow section A wholly, in which 50% of the steam is condensed and is directly exhausted as condensed water. In this way the thickness of the liquid film in the subsequent process can be effectively controlled. The steam which is not condensed in the downflow section A enters the downflow B-section and continues to be condensed. The rest 15% of steam that is not condensed enters the counterflow to be condensed. The steam which is not condensed is exhausted from the upper side. The thin and small tube bundle is employed in the downflow B-section to increase the heat exchange area and increase the heat exchange coefficient, and in this way the material consumption is reduced. The layout of the counterflow is similar to that of the downflow section A. In this way, the flow speed is reduced, the drag is lowered, super cooling can be restrained, and the exhaust can be therefore promoted.

The structural design of the radiating module takes into account the requirements on strength and stiffness. Reasonable design can enhance the strength and stiffness of the system and facilitate the installation.

A module comprises four sections and five headers, such that the stiffness of the tube bundles is enhanced. The more cooling section adds a thick tube bundle so as to increase the system stiffness. The five headers may function as a supporting face of the module, such that the strength, the stiffness and the stability of the supporting system is enhanced.

The design of a modular architecture and unitization idea is employed such that the product manufacturing process is simplified, the product is easy to transport and install, and the investment cost is low.

A cooling unit comprises 8-10 modules, each of which is equipped with a blower. A plurality of cooling units constitute a system. In this way the manufacture process is simplified and the product is easy to transport and install fast. The supporting system, the ventilation channel, the cooling water system and the water supplement system are synthetically developed so as to simplify the system configuration, lower the cost of investment, adjust the flow rate as a whole, guarantee the quality of water, and reduce the shutdown time for operational maintenance.

What is claimed is:

1. An evaporative condenser radiating module for steam exhaust of a steam turbine, characterized in that, a side steam-water separating chamber (4) between a first section (A) and a second section (B) is disposed on one side of a sealed central steam-water separating chamber (7), and the side steam-water separating chamber (4) is provided with a separating plate (9) therein, and the separating plate (9) separates the side steam-water separating chamber (4) into an upper sealed space (10) and a lower sealed space (20), the second section (B) includes counterflow cooling tube bundles (8) which are communicated between the upper sealed space (10) and the central steam-water separating chamber (7), and second downflow cooling section tube bundles (5) which are communicated between the lower sealed space (20) and the central steam-water separating chamber (7), and the counterflow cooling tube bundles (8) and the second downflow cooling section tube bundles (5) are arranged parallel with respect to each other, and each forms a 20-degree angle with respect to a horizontal plane, the upper sealed space (10) is provided with an air-pumping pipe (11), and the central steam-water separating chamber (7) is provided with a condensing water drainage pipe (12) on a bottom thereof, a sealed steam entering chamber (2) is arranged on one side of the side steam-water separating chamber (4) opposite the sealed central steam-water separating chamber (7), the first section (A) includes first downflow cooling section tube bundles (3) which are arranged between the sealed steam entering chamber (2) and the lower sealed space (20), and the first downflow cooling section tube bundles (3) are arranged in parallel with respect to each other, and each forms a 20-degree angle with respect to the horizontal plane, and the sealed steam entering chamber (2) is provided with a steam inlet nozzle (1) on one side surface thereof opposite the second downflow cooling section tube bundles (3), and the other side of the central steam-water separating chamber (7) is provided with tube bundles and a side steam-water separating chamber totally structurally identical with those arranged on the one side of the central steam-water separating chamber (7), such that the whole evaporative condenser radiating module forms a symmetric V shape.

2. The evaporative condenser radiating module for steam exhaust of a steam turbine according to claim 1, characterized in that, the counterflow cooling tube bundles (8), the second downflow cooling section tube bundles (5) and the first downflow cooling tube bundles (3) have a same length of 2-2.5 m.

3. The evaporative condenser radiating module for steam exhaust of a steam turbine according to claim 1 or 2, characterized in that, a diameter and a pipe thickness of the first downflow cooling tube bundles (3) are the same as those of the counterflow cooling tube bundles (8); the ratio of the diameter of the second downflow cooling section tube bundles (5) to that of the first downflow cooling tube bundles (3) is 80/100, and the ratio of the pipe thickness of the second downflow cooling section tube bundles (5) to that of the first downflow cooling tube bundles (3) is 2/3.

* * * * *